United States Patent [19]

Thurber

[11] Patent Number: 4,513,736

[45] Date of Patent: Apr. 30, 1985

[54] CUSHIONED MASSAGER

[75] Inventor: Robert J. Thurber, Sterling, Ill.

[73] Assignee: Wahl Clipper Corporation, Sterling, Ill.

[21] Appl. No.: 507,942

[22] Filed: Jun. 24, 1983

Related U.S. Application Data

[63] Continuation of Ser. No. 163,790, Jun. 27, 1980, abandoned.

[51] Int. Cl.[3] ..... A61H 1/00

[52] U.S. Cl. ..... 128/41; 128/24.1; 128/382

[58] Field of Search ..... 128/24.1, 24.2, 25 B, 128/32, 33, 34–36, 41, 80 R, 382, 795

[56] References Cited

U.S. PATENT DOCUMENTS

| | | | |
|---|---|---|---|
| 1,566,987 | 12/1925 | Simmons | 128/382 X |
| 2,521,874 | 9/1950 | Renstedler | 128/33 UX |
| 2,852,020 | 9/1958 | Murphy | 128/24.1 |
| 2,852,021 | 9/1958 | Jessup | 128/33 |
| 2,898,908 | 8/1959 | Heide | 128/33 |
| 2,943,620 | 7/1960 | Sibert | 128/24.1 |
| 3,055,357 | 9/1962 | Redka | 128/32 |
| 4,005,703 | 2/1977 | Rosen | 128/33 |
| 4,088,127 | 5/1978 | Clayton et al. | 128/24.1 |
| 4,149,529 | 4/1979 | Copeland et al. | 128/24.1 |

*Primary Examiner*—Richard J. Apley
*Assistant Examiner*—David J. Brown
*Attorney, Agent, or Firm*—Laff, Whitesel, Conte & Saret

[57] ABSTRACT

A massaging device includes a cushion with two pouches formed on the top of the cushion for receiving the feet or hands of the user. The cushion and pouches are vibrated by a motor built into the cushion, which motor may be powered by line voltage or by batteries. A heating pad may be in the cushion, if desired, in order to supplement the vibration with a dry heat.

10 Claims, 4 Drawing Figures

CUSHIONED MASSAGER

This is a continuation of U.S. patent application Ser. No. 163,790 filed June 27, 1980, now abandoned.

The invention relates to massagers, and more particularly to massagers which may be applied to many areas of the body, including the feet.

Vibrating pillows, hand held vibrators, or the like may be applied directly to many parts of the body to locally massage, relax and re-vitalize them. Generally, these pillows and similar devices do not surround the body parts, so that their effectiveness is somewhat limited.

Recently, foot massaging devices which use circulating water have become popular, perhaps because the feet often become sore and swollen. The water generally covers the feet completely, which maximizes the effect of the massage upon the feet. However, these circulating water devices are generally too small to be used in connection with other parts of the body, and usually they should set on the floor. Also, such circulating water devices may not be transported easily, and they should not be used in moving vehicles, offices, waiting rooms, or the like. Thus, there is a need for massaging devices which surround at least some parts of the body, such as the hands and feet without the messiness of circulating water, and which may be easily transported and used outside of the home.

Accordingly, an object of this invention is to provide new and improved massaging devices, especially for use on the human body. Another object is to provide such massaging devices in a form suitable for use with most parts of the body, and especially for surrounding parts of the body, such as the hands or feet.

Still another object is to provide new and improved massaging devices which surround certain parts of the body, such as the hands or feet, but which do not use water and which may be easily transported and used in moving vehicles, offices, waiting rooms and the like.

In keeping with one aspect of the invention, a foot massager includes a cushion with a covering having one or two pouches for receiving the hands or feet. The cushion preferably includes a vibrating energizer, such as an electo-magnetic motor, a rotary motor with offset weight, or the like which may be powered by any suitable means, such as line voltage or an auto or replaceable dry cell battery, for example. A heating element or pad may also be placed in the cushion, if desired.

The above mentioned and other features of this invention and the manner of obtaining them will become more apparent, and the invention itself will be best understood by reference to the following description of an embodiment of the invention taken in conjunction with the accompanying drawings, in which.

Figure 1:
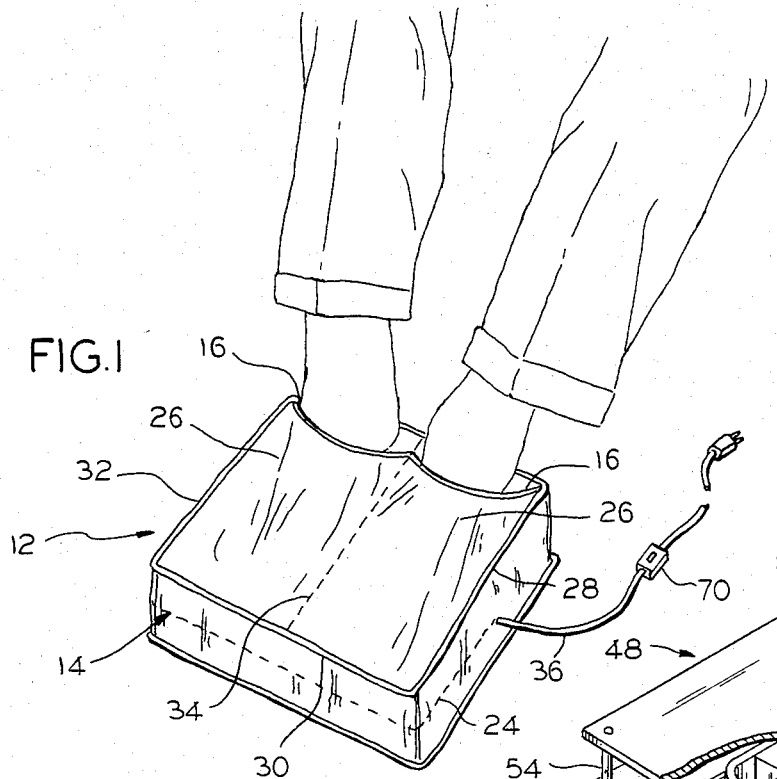
FIG. 1 is a perspective view of the cushioned massager, in use.

A massager 12 (FIG. 1) includes a cushion 14 with two pouches 16 thereon. The massager 12 may be pressed against most parts of the body to relax muscles and relieve pain. Also, the feet or hands may be put in the pouches 16, if desired, so that the massaging effect of the device will substantially surround the entire feet or hands. The cushion 14 may be made with any soft, pliable and resilient cover material, such as nylon or vinyle, and includes a top 18, a bottom 20 and four sidewalls 22. A vibrating, preferably electro-magnetic solenoid motor, and any suitable cushion stuffing material 9 are inside of the cushion 14. Also, a suitable heating unit 23 such as a heating pad, or the like may be placed inside the cushion 14, near the top 18, if desired. A zipper 24 may be used to remove and clean or replace the cushion cover and to gain access to the internal components of the device.

Two pouches 26 are here shown as foot sized covers 26 are provided on top 18 of the cushion 14. The pouches or covers 26 are secured to top 18 by sewing them to the cushion cover, or in other any suitable means. Preferably, the pouches extend outwardly to side edges 28, 30 and 32, and a center seam 34 is stitched top 18 to form the separate pouches 16. The pouches 16 may be sized to accept the hands or the feet (or either) of the user.

A cord 36 provides power for the electric motor and heating pad, if used. The cord extends into the cushion 14 and may be stored in one of the pouches 16, when not in use. The end of the cord includes a suitable plug, as for making connection with a 60-cycle 100 volt outlet, or a cigar lighter socket on an automobile. Replaceable dry cell batteries may also be built into the cushion itself.

Figure 3:
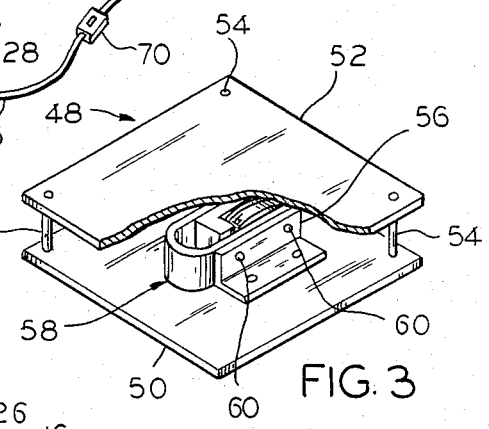
FIG. 3 is a perspective, partially broken away, showing a vibratory unit for incorporation in the inventive cushion.
Figure 4:
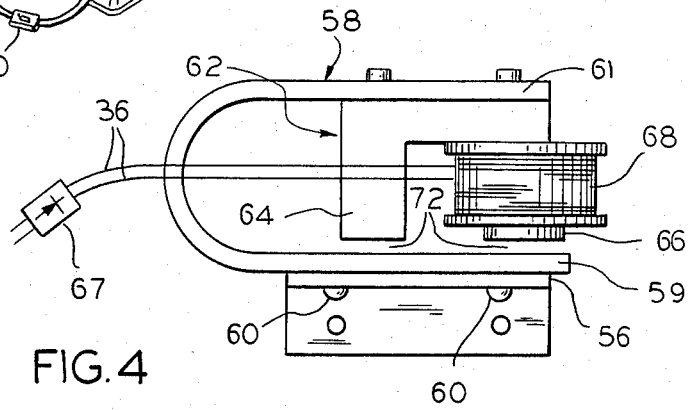
FIG. 4 is a plan view showing a magnetic solenoid type of motor which is used in the unit of FIG. 3.

The preferred vibrator motor unit 48 is seen in FIGS. 3 and 4. Two plates 50, 52, which may be metal, are held in a spaced parallel relationship by any suitable number of posts, bolts, or the like 54. These two plates 50, 52 are approximately the size of the cushion with due allowance for padding. The entire unit 48 may fit rather snugly into a cavity in a preformed foam rubber or similar cushion material.

Centrally located on one of the plates 50 is a generally upstanding flange 56 which may be an L-shaped bracket 58 (FIG. 4) having one flange secured to the plate. Mounted on the upstanding flange 56 is a horizontally oriented U-shaped metal spring 58, with one leg 59 of the "U" secured to the flange 56 by spot welding, bolts or rivets 60. Also, mounted on the other leg 61, is a laminate 62 forming a core for the solenoid.

Figure 2:
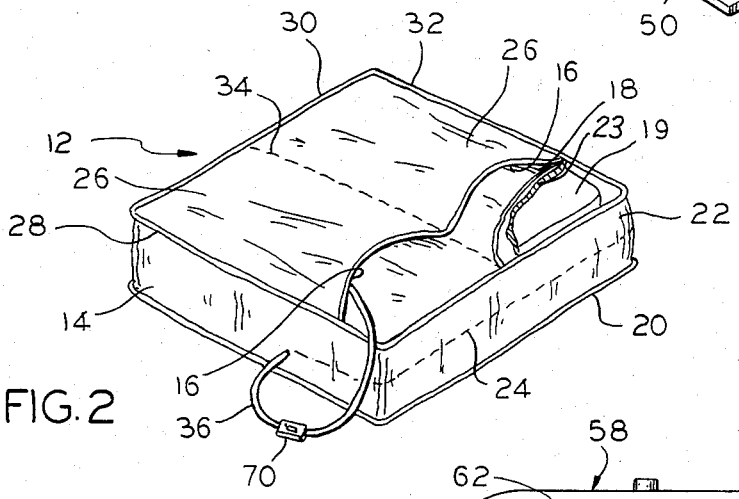
FIG. 2 is a perspective view of the same cushioned massager, not in use, with the power cord stored in a pouch and the cover partially broken away to show heating pad.

The core 62 has two outwardly projecting arms 64, 66, separated by a flat section which is secured against leg 61 of spring member 59. A spool of wire 68 slips over one of the upstanding arms 66 of core 62. Wires 36 connect this spool of wire 68 to a power service via a rectifier 67 and an off/on switch 70 (FIGS. 1, 2). When the circuit, including the spool of wire 68, is energized, a magnetic field is created in the laminated core and in the U-shaped spring leg 59 with air gaps 72 between the spring leg 59 and the core legs 66 and 64.

The preferred energizing current, derived via rectifier 67, is the half waves of one polarity which are formed by rectifying 60-cycle commerical house current. Thus, the air gap is closed each time that a rectified half wave cycle appears and opened each time that the half wave cycle disappears. As a result, there is a vibration which is translated through upstanding flange 56 and the spaced parallel plates 50, 52 to the feet or other body part within the pouches 16, 16.

While the dimensions of the device are not critical, they should be large enough to accommodate most hands and feet, yet small enough to be easily transported. In a unit actually made, the cushion measured approximately eleven inches on each side. The center seam 34 was approximately in the middle of the top 18, and the individual pouches 16, 16 were about eight inches long.

The many advantages of this massaging device are self-apparent. The device may be used when in contact with virtually any part of the body, and may encompass and cover some entire parts of the body, such as the hands or feet, for example. The device may be easily transported, and used in any convenient location. Of course, there will be other advantages apparent to those skilled in the art.

While the principles of the invention have been described above in connection with specific apparatus and applications, it is to be understood that this description is made only by way of example and not as a limitation on the scope of the invention. Therefore, the appended claims should be construed to cover all equivalent structures which fall within the true scope and spirit of the invention.

I claim:

1. Apparatus for massaging at least one human foot while said foot rests passively on said apparatus, said apparatus comprising powered vibration means, a cushion containing a stuffing material and enclosing said powered vibration means for vibrating said cushion and foot while said foot remains passively resting directly on said cushion, a cover for said cushion, said cover having a soft, limp, pliable and resilient material with an overlying member formed of said cover material and secured around at least part of the perimeter of said cover, said overlying member forming at least one pouch secured to the top of said cushion, the upper portion of the cover integrally attached to and forming the bottom part of said pouch, whereby said cover and pouch are made of said soft, limp and pliable and resilient material, and are shaped and proportioned to loosely receive and surround a major portion of a human foot inserted therein substantially independent of the posture of the body of the human whose foot is in the pouch, said pouch being limp and collapsible so that a body part may also rest on top of the cushion without being inserted into the pouch, said powered means enclosed within said cushion vibrating both said cushion cover and said pouch cloth when power is applied thereto whereby the upper part of the foot is lightly rubbed by the overlying member formed by the soft, limp and pliable and resilient pouch material.

2. The apparatus of claim 1 wherein said vibrating means includes a vibrating electro-magnetic solenoid motor, and means for applying power to said motor.

3. The apparatus of claim 1 wherein there are two of said pouches formed in a removable cover secured to said cushion, said two pouches enabling an insertion of both both feet.

4. The apparatus of claim 1 further including means inside said massaging device for dry heating said foot which may be either resting on said cushion or inserted into said pouch.

5. The apparatus of claim 3 wherein said pouches are separated by a center seam extending across the middle of a top of said cushion.

6. The apparatus of claim 5 wherein the top of said cushion is approximately eleven inches on each side, and said pouches are approximately eight inches in length.

7. A power driven dry heated vibratory member comprising a cushion for receiving and supporting the sole of a human foot resting directly upon the top of the cushion, said cushion having a cover with a soft, limp, pliable and resilient material with an overlying material forming a pouch integrally attached thereto in order to form at least one collapsible pouch on the outer and top surface thereof, said cushion having a generally rectangular shape with said cover and overlying material attached around part of the perimeter and with said overlying material stitched to said cover and down the middle thereof to cooperate with said attached perimeter part and form said pouch, whereby said limp pouch is shaped and proportioned to loosely receive at least a part of a human foot, heating pad means formed under said cover and near the top of said cushion to heat said sole of said foot, power driven vibrating means completely enclosed within said cushion and positioned under said limp pouch, whereby the limp pouch rubs over the top of the foot in the pouch responsive to the operation of said vibrating means, said vibrating means comprising a pair of plates held in a spaced parallel relationship and vibratory motor means mounted within the space between said plates, said cushion comprising core means enclosed by said cover and resiliently cradling and containing said spaced parallel plates to enable them to vibrate freely under the influence of said motor means.

8. A power driven dry heated vibratory member comprising a cushion for receiving and supporting the sole of a human foot resting directly upon the top of the cushion, said cushion having a cover with a soft, limp, pliable and resilient material attached thereto to form at least one collapsible pouch on the outer and top surface thereof, said limp pouch being shaped and proportioned to loosely receive at least a part of a human foot, heating pad means formed under said cover and near the top of said cushion to heat said sole of said foot, power driven vibrating means completely enclosed within said cushion and positioned under said limp pouch, whereby the limp pouch rubs over the top of the foot in the pouch responsive to the operation of said vibrating means, said vibrating means comprising a pair of plates held in a spaced parallel relationship and vibratory motor means mounted within the space between said plates, said vibratory motor comprises a solenoid type motor and an upstanding flange secured on one of said plates, said motor being secured to said upstanding flange which acts as a lever arm upon said one plate to increase the mechanical efficiency of the vibrating motor, said cushion comprising core means enclosed by said cover and resiliently cradling and containing said spaced parallel plates to enable them to vibrate freely under the influence of said motor means.

9. The member of claim 8 wherein said means for selectively applying power comprises rectifier means for applying one half cycle of commercial power.

10. Apparatus for massaging at least one human foot while said foot remains passive on said apparatus, said apparatus comprising powered vibration means, said vibration means comprising a pair of plates held in a spaced parallel relationship and vibratory motor means mounted within the space between said plates, a cushion containing and enclosing said powered vibration means, said cushion comprising core means enclosed by a cover and resiliently cradling and containing said spaced parallel plates to enable them to vibrate freely under the influence of said motor means, said vibratory motor comprises a solenoid type motor and an upstanding flange secured on one of said plates, said motor being secured to said upstanding flange which acts as a lever arm upon said one plate to increase the mechanical efficiency of the vibrating motor for vibrating said foot while said foot remains passively resting directly on said cushion, at least one pouch secured to the top of said cushion, the upper portion of said pouch being a soft, limp and pliable cloth, and being shaped and proportioned to loosely receive a major portion of a human foot inserted therein substantially independent of the posture of the body of the human whose foot is in the pouch, said pouch being limp and collapsible so that a body part may also rest on top of the cushion without being inserted into the pouch, said powered means enclosed within said cushion vibrating both said cushion and said pouch cloth when power is applied thereto whereby the upper part of the foot is lightly rubbed by the soft, limp and pliable pouch.

* * * * *